US006428290B1

(12) United States Patent
Wang

(10) Patent No.: US 6,428,290 B1
(45) Date of Patent: Aug. 6, 2002

(54) AIR PUMP

(76) Inventor: Lo-Pin Wang, 16F-2, No. 17, Lane 52, Sec. 3, Re He Rd., Taichung (TW)

( * ) Notice: Subject to any disclaimer, the term of this patent is extended or adjusted under 35 U.S.C. 154(b) by 0 days.

(21) Appl. No.: 09/611,414

(22) Filed: Jul. 6, 2000

(51) Int. Cl.[7] ..... F04B 19/02
(52) U.S. Cl. ..... 417/468; 417/521; 417/528
(58) Field of Search ..... 417/468, 521, 417/528, 530, 298

(56) References Cited

U.S. PATENT DOCUMENTS 4,508,490 A * 4/1985 Ramirez et al. ..... 417/234
5,435,703 A * 7/1995 Lin ..... 417/428
5,628,350 A * 5/1997 Gibb ..... 141/38
5,779,457 A * 7/1998 Chuang et al. ..... 417/460
5,873,705 A * 2/1999 Chen ..... 417/259
5,997,256 A * 12/1999 Gunther ..... 417/259
6,027,319 A * 2/2000 Winefordner et al. ..... 417/440
6,202,714 B1 * 3/2001 Wang ..... 141/329
6,257,849 B1 * 7/2001 Wu ..... 417/469
6,318,969 B1 * 11/2001 Wang ..... 417/63

* cited by examiner

*Primary Examiner*—Charles G. Freay
*Assistant Examiner*—Han Lieh Liu
(74) *Attorney, Agent, or Firm*—Browdy and Neimark, P.L.L.C.

(57) ABSTRACT

An air pump comprises an outer tube, a distribution guide tube, and a spring. The outer tube is provided in the interior with a large cylinder and a small cylinder. The distribution guide tube is disposed at the lower end of the outer tube and is provided with two air chambers, one of which is in communication with the large cylinder and is provided with a pressure leaking slide block, two leakproof rings, and an annular groove located between the two leakproof rings for forming a duct. The spring is disposed in the air chamber for providing the pressure leaking slide block with a recovery spring force. Another air chamber of the distribution guide tube is in communication with the large cylinder and the small cylinder for discharging air to inflate an inflatable object.

5 Claims, 3 Drawing Sheets

AIR PUMP

FIELD OF THE INVENTION

The present invention relates generally to an air pump, and more particularly to a bicycle air pump.

BACKGROUND OF THE INVENTION

The conventional air pump is provided with a large cylinder and a small cylinder, which are shifted by a switching device in the midst of the inflation process. The operation of the switching device is done manually. The manual operation of the switching device causes a great deal of inconvenience to the user of the air pump.

SUMMARY OF THE INVENTION

The primary objective of the present invention is to provide an air pump which is free from the drawback of the conventional air pump described above.

The air pump of the present invention comprises at least two cylinders, a distribution guide tube, and a spring. The distribution guide tube is disposed at the lower end of an outer tube in which the large and the small cylinders are disposed. The distribution guide tube is provided therein with two air chambers, one of which is in communication with the large cylinder and is provided with a pressure leaking slide block in intimate contact with the inner wall of the air chamber. The pressure leaking slide block is provided with a channel which is opened or closed along with the movement of the slide block. The spring is disposed in the air chamber for providing the pressure leaking slide block with the recovery spring force. Another air chamber is in communication with the large and the small cylinders for inflating an inflatable object.

DETAILED DESCRIPTION OF THE INVENTION

Figure 1:
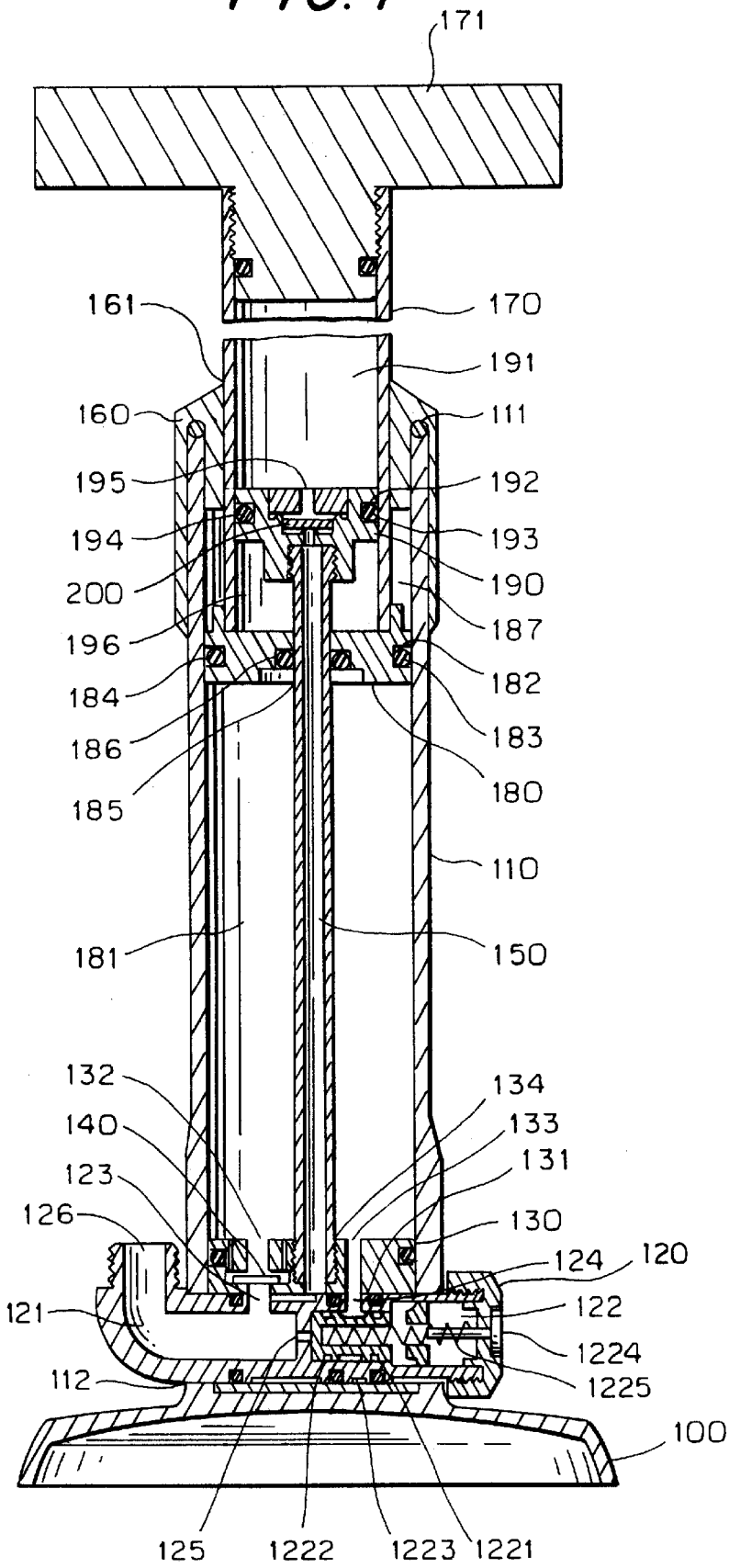
FIG. 1 shows a longitudinal sectional view of the present invention.

As shown in all drawings provided herewith, an air pump of the present invention comprises the component parts which are described hereinafter.

A base 100 is of a disk like construction and is rested on the floor.

An outer tube 110 is round in its cross section and is disposed in the top of the base 100. The outer tube 110 is provided at the top end thereof with an opening 111. The outer tube is provided in the proximity of the base with a through hole 112 extending throughout the radial direction of the outer tube.

A distribution guide tube 120 is disposed in the through hole 112 of the outer tube and is divided into a front air chamber 121 and a rear air chamber 122, which are respectively in communication with an equipressure hole 125 of the outer tube 110 for keeping these two air chambers equal to each other in air pressure. The front air chamber 121 is provided at one end with an air outlet 126, which is connected with an air discharging tube (not shown in the drawings). The rear air chamber 122 is provided with a pressure leaking slide block 1221 of a columnar construction and capable of sliding along the direction of the longitudinal axis of the air chamber. The pressure leaking slide block is provided with two leakproof rings 1222 fitted thereover and is received hermetically in the rear air chamber 122, thanks to the two leakproof rings 1222. The pressure leaking slide block is provided in the outer surface with an annular groove 1223 which is located between the two leakproof rings. The air chamber 122 is provided at one end with a pressure leaking adjustment knob 1224 fastened therewith. The spring 1225 is disposed in the rear air chamber such that the spring urges the pressure leaking slide block 1221 and the pressure leaking adjustment knob 1224. The spring affords a recovery spring force to the pressure leaking slide block.

A base member 130 is disposed at the bottom end of the interior of the outer tube 110, and is provided with a through hole 131 corresponding in location to the through hole 112 of the outer tube. The distribution guide tube 120 is disposed in the through hole 131. The base member is provided with two through ducts 132 and 133, which are corresponding in location to the through holes 123 and 124. The through duct 133 is in communication with the through hole 131. The base member is further provided with a guide hole 134 for connecting the interior of the outer tube with the front air chamber 121.

A check valve 140 is disposed in the through duct 132 to allow the one-way passage of air into the front air chamber from the outer tube.

A guide tube 150 is disposed in the outer tube such that the guide tube is in communication with the guide hole 134 of the base member.

An upper cover 160 is fastened with the top end opening of the outer tube and is provided with a round hole 161.

An inner cylinder 170 is received at one end thereof in the round hole of the upper cover and is provided at other end thereof with a handle 171 fastened therewith.

An outer tube piston 180 is disposed in the outer tube such that the outer tube piston and the base member form therebetween a first pressure chamber 181. The outer tube piston 180 is provided in the outer surface with an annular groove 182 in which a leakproof ring 183 is disposed. The piston is hermetically received in the outer tube 110 such that a one-way air admission valve 184 is formed so as to enable air to enter in one-way manner the first pressure chamber. The piston is provided in the center with a receiving hole 185 for receiving the guide tube. The receiving hole is provided therein with a leakproof ring 186.

An inner cylinder piston 190 is disposed in the inner cylinder 170 such that a second pressure chamber 191 is formed between the inner cylinder piston and the handle 171. The inner cylinder piston is provided in the outer surface with a circular groove 192 in which a leakproof ring 193 is received, thereby forming a one-way air admission valve 194 allowing one-way passage of air into the second pressure chamber. The inner cylinder piston is provided in the center with a guide flow hole 195 in communication with the guide tube 150.

A check valve 200 is disposed in the guide flow hole 195 of the inner cylinder piston to allow one-way passage of air into the guide tube 150 from the second pressure chamber 191.

Figure 2:
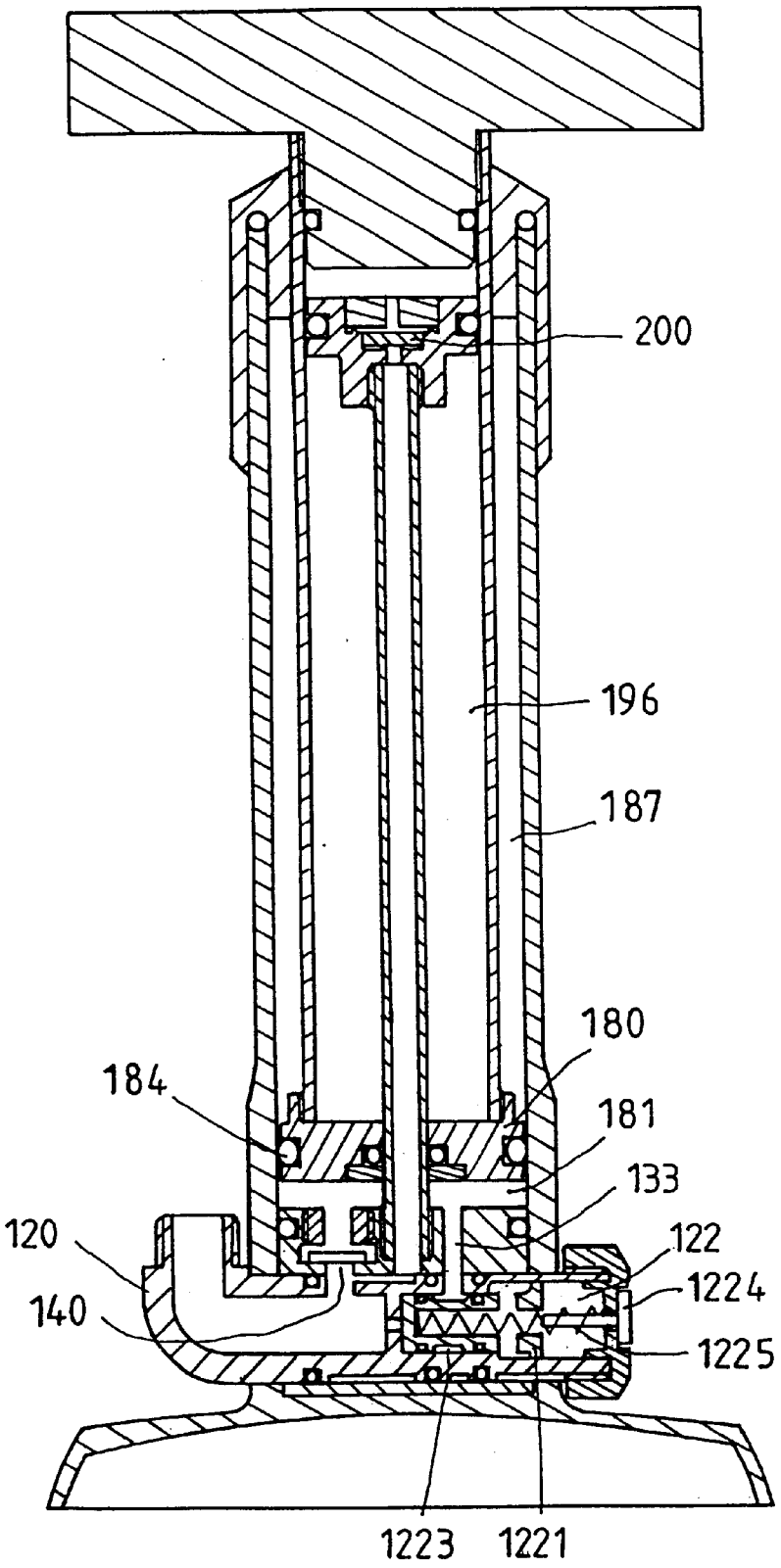
FIG. 2 shows a schematic view of the present invention in action.

As shown in FIG. 2, the handle 171 and the outer tube piston 180 are located at the standby positions. As the handle is pressed to initiate the inflation process, the inner cylinder 170 and the outer tube piston 180 are actuated to compress air in the first pressure chamber 181. The air is discharged from the air outlet 126 via the through duct 132 and the distribution guide tube 120. In the meantime, the air in the second pressure chamber 191 is compressed by the inner cylinder piston 190 such that the compressed air is forced out of the front air chamber 121 via the guide flow hole 195, the check valve 200, and the guide tube 150. The flow through hole 124 of the lower end of the first pressure chamber is sealed off by the pressure leaking slide block 1221 which remains stationary. The atmospheric air is allowed to enter the outer tube via the gap located between the outer tube 110 and the upper cover 160. The air is subsequently allowed to flow into the inner cylinder via the space 187 located between the outer tube piston 180 and the upper cover 160 as well as the gap between the inner cylinder 170 and the outer tube piston. The air is further allowed into the space 196 between the outer tube piston 180 and the inner cylinder piston 190.

When the outer tube piston 180 is pulled upward to result in a decrease in pressure of air in the first pressure chamber 181, thereby attracting the air in the space 187 to enter the first pressure chamber 181 via the one-way air admission valve 184. Similarly, in light of the upward movement of the outer tube piston 180, the air in the space 196 is drawn into the second pressure chamber 191, so as to complete the preparation for the second round of the inflation process. The air in the distribution guide tube 120 is prevented from flowing in reverse by the check valves 140 and 200.

As the inflation precess is repeatedly carried out, the air pressure in the distribution guide tube 120 becomes greater. The pressure leaking slide block 1221 is thus forced by the air pressure to move toward the pressure leaking adjustment knob 1224, thereby resulting in the compression of the spring 1225. As soon as the air pressure in the distribution guide tube is increased to a predetermined value, the pressure leaking slide block 1221 is forced by the air pressure in the distribution guide tube to displace a predetermined distance. As a result, the through duct 133 is in communication with the atmospheric air via the rear air chamber 122 due to the displacement of the circular groove 1223 of the pressure leaking slide block.

Figure 3:
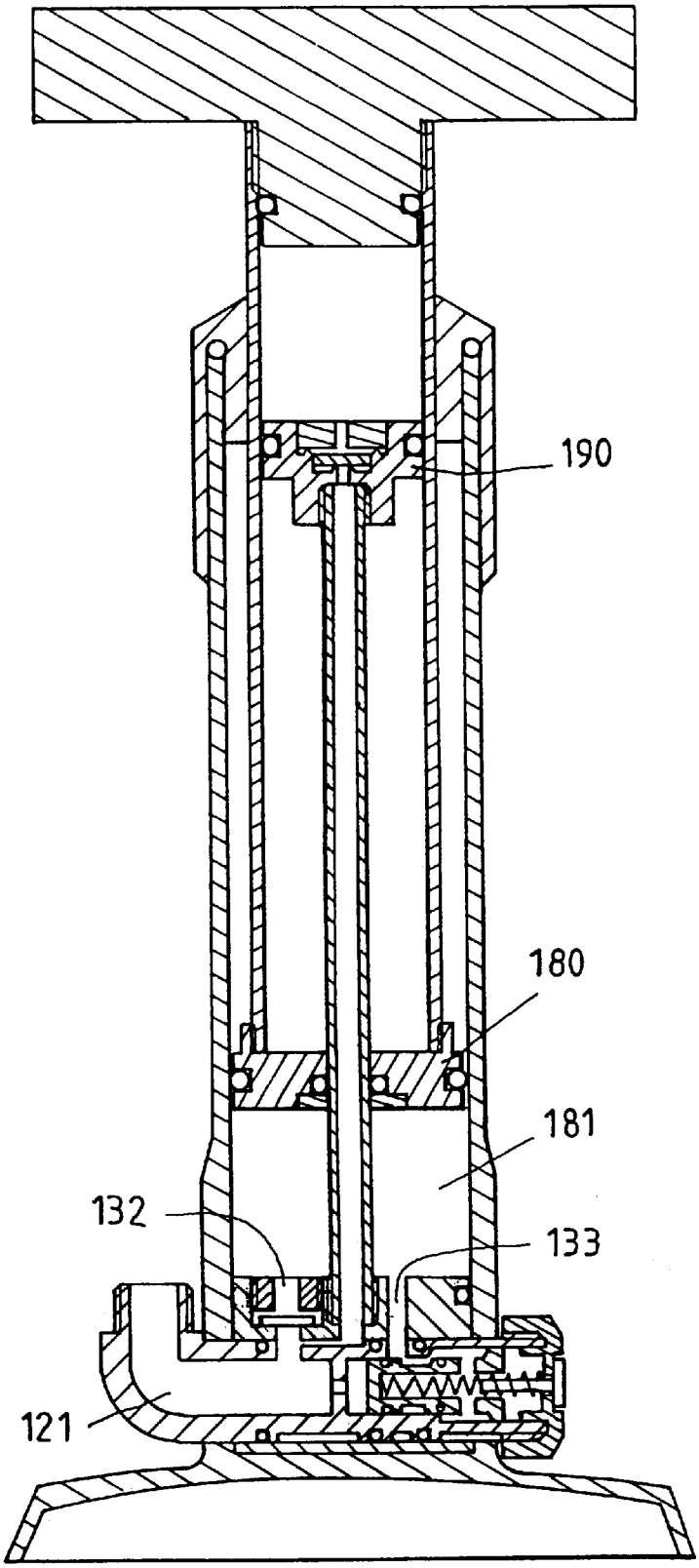
FIG. 3 shows a schematic view of a pressure adjusting block of the present invention in action.

As shown in FIG. 3, when the through duct 133 is in communication with the atmospheric air, the air which is forced out of the first pressure chamber 181 is discharged without flowing into the front air chamber 121 via the through duct 132. As a result, the outer tube piston 180 becomes an invalid piston under the high pressure. If the inflation process persists thereafter, only the small inner cylinder piston 190 works to inflate the inflatable object. In view of such an automatic switching of the inflation process, the inflation work is made easy.

What is claimed is:

1. An air pump comprising:

a base in contact with the ground;

an outer tube mounted on said base and provided at one end with an opening, said outer tube provided in proximity of said base with a through hole extending along the direction of a radius of said outer tube;

a distribution guide tube disposed in said through hole of said outer tube and divided into a front air chamber and a rear air chamber in communication with said front air chamber by an equipressure hole, said two air chambers being in communication with said outer tube by a flow through hole, said front air chamber provided at one end with an air outlet, said rear air chamber provided therein with a pressure leaking slide block which is provided therein with a duct, said rear air chamber provided therein with a spring for providing said pressure leaking slide block with a recovery spring force;

a base member disposed in a bottom end of the interior of said outer tube and provided with two through ducts in communication with said two air chambers of said distribution guide tube, said base member further provided with a guide hole extending throughout said base member for communicating the interior of said outer tube with said front air chamber;

a check valve disposed in said through duct corresponding in location to said flow through hole of said front air chamber, said check valve allowing the one-way passage of air from said outer tube into said front air chamber;

a guide tube disposed in said outer tube such that said guide tube is in communication with one end of said guide hole of said base member;

an upper cover covering said opening of said top end of said outer tube, said upper cover provided with a round hole;

an inner cylinder received at one end thereof in said round hole of said upper cover and provided at other end thereof with a handle fastened therewith;

an outer tube piston disposed in said outer tube such that a first pressure chamber is formed between said outer tube piston and said base member, said outer tube piston provided with a one-way air admission valve fitted thereover, said outer tube piston provided in the center with a receiving hole for receiving said guide tube whereby said receiving hole is provided with a leakproof ring fitted thereinto;

an inner cylinder piston disposed in said inner cylinder such that a second pressure chamber is formed between said inner cylinder piston and said handle, said inner cylinder piston provided with a one-way air admission valve fitted thereover, and a guide flow hole in communication with said guide tube; and a check valve disposed in said guide hole of said inner cylinder piston to allow one-way passage of air into said guide tube from said second pressure chamber.

2. The air pump as defined in claim 1, wherein said rear air chamber is fastened at one end thereof with a pressure leaking adjustment knob; and wherein said spring urges said pressure leaking slide block and said pressure leaking adjustment knob for providing said pressure leaking slide block with a recovery spring force.

3. The air pump as defined in claim 1, wherein said pressure leaking slide block is provided with at least two leakproof rings fitted thereover, and in the outer surface thereof with a circular groove forming said duct.

4. The air pump as defined in claim 1, wherein said outer tube piston is provided in the outer surface with at least one annular groove, and one leakproof ring disposed in said annular groove to enable said outer tube piston and the inner wall of said outer tube to form said oneway air admission valve.

5. The air pump as defined in claim 1, wherein said inner cylinder piston is provided in the outer surface thereof with at least one circular groove, and one leakproof ring disposed in said circular groove to enable said inner cylinder piston and the inner wall of said inner cylinder to form said one-way air admission valve.

* * * * *